United States Patent [19]

Glander

[11] Patent Number: 4,491,995

[45] Date of Patent: Jan. 8, 1985

[54] PROCESS FOR THE LEVEL EXHAUST DYEING OF POLYESTER FIBERS

[75] Inventor: Siegfried Glander, Bad Soden am Taunus, Fed. Rep. of Germany

[73] Assignee: Hoechst Aktiengesellschaft, Fed. Rep. of Germany

[21] Appl. No.: 473,757

[22] Filed: Mar. 9, 1983

[30] Foreign Application Priority Data

Mar. 20, 1982 [DE] Fed. Rep. of Germany ..... 3210380

[51] Int. Cl.[3] ..... D06B 5/18

[52] U.S. Cl. ..... 8/158; 68/198

[58] Field of Search ..... 8/158, 155.1; 68/184, 68/189

[56] References Cited

FOREIGN PATENT DOCUMENTS

| | | | |
|---|---|---|---|
| 2534618 | 2/1977 | Fed. Rep. of Germany | 8/158 |
| 10770 | 1/1978 | Japan | 8/158 |
| 1450602 | 9/1976 | United Kingdom | 68/184 |

*Primary Examiner*—Philip R. Coe

*Attorney, Agent, or Firm*—Connolly and Hutz

[57] ABSTRACT

A process for the level exhaust dyeing of polyester fiber textile material is accomplished by dissolving unfinished disperse dyestuff synthesis material in as high a concentration as possible in an organic solvent miscible with water. This solution is forced into an aqueous liquor already at a dyeing temperature of 90° to 140° C. and already circulating through the polyester fiber textile material. Dyeing of the material then occurs in the usual manner.

12 Claims, 3 Drawing Figures

PROCESS FOR THE LEVEL EXHAUST DYEING OF POLYESTER FIBERS

The present invention relates to a process for the level exhaust dyeing of textile material which consists of hydrophobic synthetic fibers, preferably polyester (PES) fibers, either on its own or as a component of mixtures with natural or other synthetic fibers, with heat-settable colorants in a closed machine system not only under high-temperature (HT) conditions under the elevated pressure which becomes established but also under atmospheric pressure at temperatures between 90° and 140° C., from an aqueous medium by means of a moving liquor which is circulated in the dyeing system until the colorant has exhausted onto the textile material and become fixed therein.

Exhaust techniques of the abovementioned type for dyeing PES fibers with aqueous dispersions of water-insoluble dyestuffs under HT conditions have been long proven in industry and are carried out in various versions. In one existing method, the liquor prepared from the dyestuff plus additives and, if desired, auxiliaries is slowly heated from the start together with the goods to the envisaged dyeing temperature of 120° to 130° C. However, the process has even been carried out in such a way that the textile goods and a dyestuff-free treatment bath flowing through the goods are initially raised together to the dyeing temperature or hot water from the outset at the dyeing temperature is introduced into the circulation system, the separately dispersed dyestuff batch is then injected into the hot liquor via a bypass or injector, and the liquor is finally circulated until the dyeing operation has ended. In an isothermal dyeing method disclosed in German Pat. No. 2,331,669 under the name "Rapidcolor process", the entire dyeing liquor, including the dyestuff, is heated up to about the dyeing temperature in a make-up vessel separate from the actual dyeing vessel and then with the aid of relative overpressure speedily transferred into the connected circulation dyeing machine which contains in the form of a pack or packages the fiber material from which the air has been removed in a preparative step by means of steam flow, at the same time heating up the fiber material to about the dyeing temperature. During this liquor inflow phase, the steam atmosphere is made to condense completely, and the dyeing vessel is completely filled with the liquor forced in. German Auslegeschrift No. 2,456,250 describes a further development of the process just described, in which a concentrated dyestuff batch dispersed in water is injected via a mixing section into the hot blank total liquor at the dyeing temperature, and the dyeing vessel, containing the textile goods preheated by steam injection, is rapidly filled with the exhaust bath thus formed.

Almost all of the above prior art methods introduce the predispersed dyestuff in one go into the dyeing system heated to the dyeing temperature. This practice has disadvantages in respect of the reliability of the process and the levelness of the dyeing. German Pat. No. 2,534,562 has therefore already proposed to carry out the injection of such highly concentrated aqueous dyestuff dispersions a little at a time in accordance with the rate at which dyeing liquor circulates through the dyeing material.

German Offenlegungsschrift No. 2,239,563 describes another process for the isothermal dyeing of PES fibers with dyestuffs which have a solubility in water of 2 to 20 mg/l, in a closed dyeing system with a moving liquor, in which the dyestuffs are first dissolved in an organic solvent which is immiscible with water, water is then bubbled through this solution at elevated temperatures, the resulting aqueous solution of the dyestuff is pumped in the same circulation system through the material to be dyed, and the aqueous solution depleted of dyestuff is passed again through the liquid store of dyestuff in organic solvent. The way this method works is to enable the dyestuff to migrate from the solvent into the water, dissolve therein due to its specified solubility, and thus be applied very slowly by the circulating liquor to the PES fiber.

Colorants which have been found to be suitable for the purpose described are, in particular, disperse dyestuffs. Disperse dyestuffs, which, as is known, do not contain any solubilizing group in the molecule, are organic compounds which are sparingly soluble in water but where the proportionally small part that does dissolve in water has substantial affinity for polyester fibers. Apart from dyeing such dyestuff species from organic solvents, which method has not become established in industry, synthetic fibers are dyed from an aqueous phase via the dispersed dyestuff by finely dividing the latter with appropriate additives, such as a relatively large amount of dispersant (to stabilize the liquor), without which finely divided state it would be impossible to achieve an unpatchy and level dyeing. In this method, the actual dyeing process involves the adsorption of the dissolved, monomolecular dyestuff to the surface of the PES fiber and the subsequent diffusion of the dyestuff into the interior of the fiber. The solution equilibrium disturbed in the liquor in the course of this exhaustion process is restored to its balanced state by further dissolving of dyestuff from the dispersed state.

It is thus very important for the commercial form of these disperse dyestuffs to have, for use from an aqueous medium, a good finish to ensure their dispersibility and the stability of the dispersion in the liquor, to avoid filtered-off deposits and the associated unlevelness on the goods and the usually simultaneously resulting poor rub fastness.

The finish of commercial dyestuffs thus has a great influence on the dyeing properties and constitutes about half of the cost of manufacturing a dyestuff. Despite all that, problems occur again and again in PES exhaust dyeing due to the different leveling properties of disperse dyestuffs.

It is, then, an object of the present invention to provide dyestuffs or pigments without a finish or without a binder for any version of exhaust dyeing PES fibers from an aqueous bath and thus to simplify the treatment steps. Prime importance is given to obtaining level dyeings in a short time even with poor-leveling dyestuffs and to saving on the high finishing costs.

This object is achieved according to the invention by dissolving dyestuffs and/or pigments which are virtually insoluble or sparingly soluble in water, without prior formulation with a finish designed for suitable dyeing properties, or in the absence of special binders, in one or more organic solvents which, under dyeing conditions, are sufficiently soluble in or miscible with water, and then introducing the solution thus obtained into the circulating aqueous liquor which is already at the dyeing temperature, is flowing through or around the textile material, and is free of dyestuff or depleted of dyestuff.

The process claimed utilizes, in an advantageous manner, the fact that on injection of a water-insoluble dyestuff, dissolved in an organic solvent of the type defined above, into hot water at about 130° C., the amount of dyestuff remaining in solution is, surprisingly, higher than the amount that dissolves in the aqueous liquor when a dyestuff dispersion is conventionally heated to 130° C. The inventive idea on which the present case is based is, then, to utilize this experimental observation directly for dyeing and to meter the dyestuff solution obtained in the above manner, also without and further auxiliary, at the dyeing temperature a little at a time into the circulation of a moving aqueous liquor in such a way that better levelness of the dyeings is obtained by exploiting the increased concentration of monomolecular dyestuff. Since it is usually the case that a larger amount of dyestuff dissolved in the organic solvent can be introduced into the hot aqueous liquor when metered in a little at a time than can remain in solution, it is likely that the recrystallized dyestuff content is present in a crystal modification which is more favorable for the further dissolving into the monomolecular form than is normally the case with conventionally dispersed dyestuff. However, it was, in this context, completely unforeseeable that to proceed in such a way would produce, on the textile material, defect-free and level dyeing even with the use of unfinished dyestuffs.

All those organic solvents are suitable for the process according to the invention which, under the dyeing conditions used, are at least partially soluble in water or miscible with water and in which the pure dyestuff and/or the pigment can be dissolved in a sufficiently high concentration. According to the process, the dyestuff or pigment can also be dissolved in the organic solvent at elevated temperatures and the solution can be introduced into the circulating liquor from a heated make-up vessel. Examples of such solvents, which are used by themselves or in the form of mixtures, are alcohols, such as 3-methoxybutanol, but in particular the glycols and their ethers or the esters of such glycol ethers, such as glycol (monoethylene glycol), diglycol, triglycol, methyl glycol, methyl glycol acetate, methyl diglycol, ethyl glycol, ethyl diglycol, ethyl diglycol acetate, propyl glycol, n-butyl glycol or n-butyl diglycol, ketones, such as acetone, methyl ethyl ketone or diacetone alcohol, cyclic ethers, such as tetrahydrofuran, tetrahydrofurfuryl alcohol or dioxane, esters and lactones, such as glycol monoacetate, sec.-butly acetate, ethyl lactate or butyrolactone, lower carboxylic acids, such as formic acid or acetic acid, nitrogen-containing compounds, which may be cyclized, such as dimethylformamide, dimethylacetamide, pyridine, N-methylpyrrolidone or morpholine, and sulfur-containing compounds, such as dimethyl sulfoxide. Polar aprotic solvents are particularly highly suitable. Specific examples of these are dimethylformamide and dimethyl sulfoxide.

The dyestuffs used according to the invention are primarily disperse dyestuffs which fulfill the abovementioned conditions in respect of solubility. Such products are generally known, and are described in the Colour Index, 3rd Edition, Volume 2, under the class name "Disperse Dyes". Structurally, most disperse dyestuffs belong to the azo, anthraquinone or, in a few cases, to the nitro or quinophthalone compounds.

In the process claimed, disperse dyestuffs can advantageously be used in the unfinished state, for example in the form of a press cake, i.e. in the state in which they arrive from the synthesis stage and not yet provided with the finish [unfinished synthesis (crude) material]. In addition to the advantage of making unfinished dyestuffs available for PES exhaust dyeing, the present invention also enables very level dyeings to be obtained with those finished disperse dyestuffs which are very difficult to dye level in existing exhaust processes.

For the purposes of the present invention it is also possible to use pigments provided they satisfy the requirements in respect of the solubility, in particular organic pigments which in the course of the novel process do not require a binder system as a mediator for their bond to the fiber, and which are classified in the Colour Index, 3rd Edition, Volume 3, under the heading "Pigments". The products listed under the heading "Solvent Dyes" in the Colour Index, 3rd Edition, Volume 3, have also proved suitable for the process.

To carry out the novel process, the said dyestuffs and/or pigments (in the abovementioned state) are dissolved alone or mixed in a concentration as high as possible in a solvent (of the type defined above), and this concentrated dyestuff solution is injected into the aqueous dyeing liquor in a metered fashion a little at a time at certain intervals, advantageously distributed over several pumping cycles when the direction of flow alternates. In the case of good-leveling dyestuffs the entire amount of the dyestuff required for the dyeing can be added to the circulating liquor in the form of a concentrated solution in one go, in a single charge or in a few portions, while worse or poor-leveling dyestuffs need to be introduced in several portions at certain intervals or distributed over various pumping cycles.

Compared to existing techniques for exhaust dyeing synthetic fibers with water-insoluble dyestuffs in the form of aqueous dispersions, the process according to the invention offers a number of advantages:

The pure dyestuffs which can be used for dyeing are considerably cheaper in the form of unfinished synthesis material than as the finished commercial products. They need only be standardized to the same dyeing strength.

The process can use dyestuffs and pigments which had hitherto, in the finished form or provided with a binder, seemed unsuitable for obtaining level dyeings on PES.

The dyeings according to the invention, which use unfinished dyestuffs, are now obtained in very good levelness even compared to dyeings with the corresponding finished disperse dyestuffs which were hitherto difficult to dye level using conventional methods.

In many cases the dyeing time is shortened because level dyeings are rapidly obtained.

Since, in most cases, no or very little dispersant and/or leveling agent are admixed to the dyestuff solution in the make-up vessel or to the circulating, blank liquor, no residues of these materials remain on the fiber or in the bath. This simiplifies the aftertreatment of the dyed goods or shortens the aftertreatment time.

For instance, it is in many cases possible to dispense with reduction-clearing and the dyeing need only be rinsed.

Provided there are no surfactants present in the bath, another dyeing can easily be carried out from the aqueous residual liquor remaining after a first dyeing has exhausted.

The penetration of the PES fiber is, in the process according to the invention, in most cases superior to that in existing methods for this purpose.

If finished disperse dyestuffs which are difficult to dye level using the existing exhaust methods are used in their finished commercial state in the new working method, a much better levelness and hence, again, a saving in time can be achieved.

The present invention is technically easily realized, because any existing circulation dyeing machine can be used for the new process and a controlled prior art injection device can be installed without difficulty into the liquor circulation system of the dyeing machines. In agreement with the process measures to be carried out, the blank liquor (without dyestuff) can advantageously be heated as rapidly as possible to the dyeing temperature. An additional make-up vessel for heating up the dyeing liquor, as required by the isothermal rapidcolor process according to German Pat. No. 2,331,669, can be dispensed with according to the invention.

The process claimed is very reliable to carry out, and produces highly reproducible dyeings, because it is an easy matter to control the metering or the injection of the dyestuff solution automatically, in particular since the working of modern dyeing machines is already program-controlled.

An apparent disadvantage compared to the conventional method of dyeing from an aqueous dispersion is the organic solvent in the residual liquor and the associated polluted effluent. About this it should be said that the concentration of such a solvent in the liquor is very low (for example 0.3% by volume in Example 1), that instead in most cases no dispersant or leveling agent passes together with the residual liquor into the effluent, that it may be possible to dispense with the reduction-clearing of the dyeings and hence no alkali and no sodium dithionite pass into the effluent, and that, finally, it is possible to use biologically readily degradable organic solvents. If prior art dyeings, which use commercial dyestuffs, which contain non-degradable anionic standardizing agents, are compared with the corresponding dyeings by the process according to the invention, where many pure dyestuffs can be dissolved so highly concentrated that only very small amounts of an organic, fully degradable solvent need be used, the degree to which the effluent is polluted in the new process should even be classified as lower.

Dyeing machines which can be used to carry out the process described are, when normal PES fibers are to be dyed, any HT dyeing machine having a circulating liquor, for example package and beam dyeing machines, including those having separate make-up vessels, which are normally used for isothermal dyeing methods, and also any HT jet dyeings machine. When modified PES fibers, for example types which can be dyed without carrier, are to be dyed, suitable dyeing machines also include those which work at the boil under atmospheric pressure and of the same design.

The concentrated dyestuff solution can be introduced into the circulating liquor in various ways. It is metered in either via a secondary or sampling chamber or via a separate vessel. Illustrative embodiments of such metering devices which can be used according to the invention are depicted diagrammatically in the appended drawings. For example, the dyestuff solution can be introduced with the aid of a bypass line which can be sealed off from the pressurized dyeing system and which features a make-up or supply vessel for preparing and holding the dyestuff solution. The dyestuff solution is then distributed in the total dyeing liquor by including the bypass in the liquor cycle. However, it is also possible to feed in the dyestuff solution with the aid of an injector via an appropriate valve control. This process can be accomplished by applying pressure, in the form of, for example, compressed air, steam or an inert gas, to the surface of a dyestuff solution which is deposited in a heatable make-up or supply vessel which can be sealed pressure-tight, is equipped with a compressed air supply and is directly or indirectly, namely via a riser, connected through an inserted metering valve with the liquor cycle. The metering of the dyestuff solution into predetermined portions can be accomplished by means of an appropriate control, for example a magnetic valve or a pneumatically controlled valve, by hand or automatically, at certian times or sub-divided over a predetermined number of pumping cycles.

Yet another version of metering the dyestuff solution makes use of the sucking action of a pump. In this case, the injector will in principle consist of an additional pump which transports the dyestuff solution from a make-up or supply vessel under atmospheric pressure into the pressurized dyeing system.

Novel features and advantages of the present invention in addition to those mentioned above will become apparent to those skilled in the art from a reading of the following detailed description in conjunction with the accompanying drawing wherein similar reference characters refer to similar parts and in which.

Figure 1:
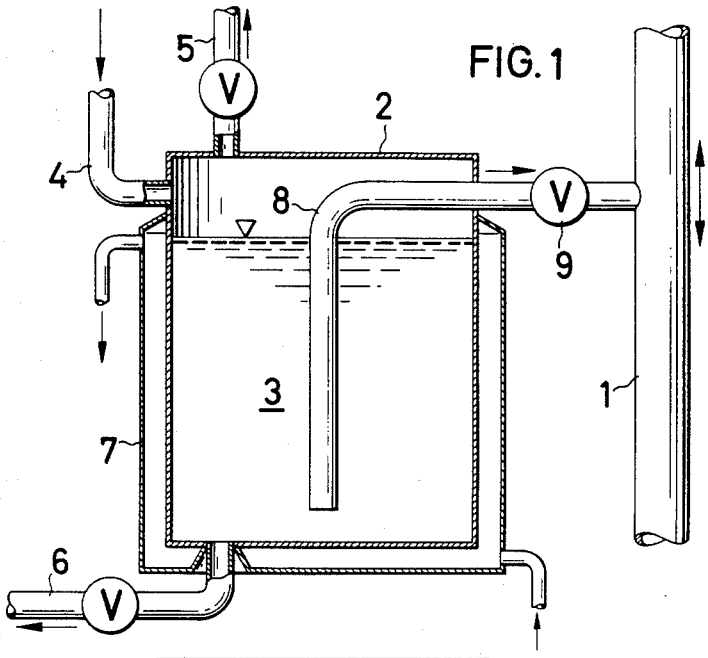
FIG. 1 is a side elevational view of a metering device for supplying dyestuff solution to the liquor recycle of a yarn dyeing system, portions being broken away to show interior details.

The examples which follow serve to illustrate the invention.

EXAMPLE 1

The dyeing described below was carried out in a yarn dyeing machine essentially comprising a pressure-tight dyeing vessel containing supports for the textile goods to dyed, a pipe connected to the dyeing vessel and forming part of the liquor cycle, and a pump for circulating the liquor, and the said pipe (1) contains a connection to the metering device depicted in FIG. 1 and used for feeding the dyestuff solution into the liquor cycle.

This metering device itself comprises a make-up or supply vessel (2) which contains the dyestuff solution (3) and is equipped with a supply (4) for compressed air or a compressed gas, a sealable pressure release (5), a sealable liquid-discharge pipe (6), and a heating jacket (7) for controlling the temperature in the dyestuff solution (3). A riser (8) which almost reaches to the floor of the vessel is bent at about right angles at the top and leads out of the make-up or supply vessel (2), and constitutes, via a metering valve (9), the connection to the pipe (1) of the liquor circulation system. The riser (8) is provided for removing portions of the dyestuff liquid (3) from the make-up or supply vessel (2) and passing them into the pipe (1), which is accomplished by applying a relative overpressure to the surface of the dyestuff solution (3), and, preferably at the dyeing temperature, uniformly distributes the dyestuff solution (3) in the total dyeing liquor, which, due to the action of the pump, pulsates in alternating direction through the pipe (1), the dyeing vessel and the textile goods and is blank or depleted of dyestuff.

20 2 kg PES fiber muffs were dyed with the unfinished synthesis material of the dyestuff C.I. Disperse Yellow 114, as follows:

130 g of pure dyestuff were dissolved at 80° C. in 1,000 $cm^3$ of dimethylformamide, and this solution was deposited in the steam-heated make-up vessel (2) of the metering device of FIG. 1, described above.

In the meantime, the dyeing vessel containing the textile goods to be dyed had been charged with a blank liquor of 320 l of water. This liquor was initially acidified to pH 5, and then circulated with heating and alternating direction of flow via the dyeing vessel's circulation system formed in association with pipe (1) at the dyeing temperature of 130° C. through the PES muffs. The flow-reversal intervals each comprised a 4 minute period of out to in flow and a 3 minute period of in to out flow. The dyestuff solution (3) was metered into the circulation of the total liquor at the rate of about $\frac{1}{3}$ of the make-up quality for each of 3 flow-reversal intervals.

The dyestuff solution (3) was transferred with the aid of nitrogen injected into the make-up vessel (2) and pressing down onto the surface of the liquid with a pressure of 5 bar. As soon as the metering valve (9) was then opened, the dyestuff solution rose in the riser (8) due to the elevated pressure acting on the surface of the liquid outside this riser, and thus passed into the circulating liquor.

After a 20 minute dyeing time the dyeing system was cooled down, and the textile goods were removed from the dyeing vessel and were not reduction-cleared but only rinsed with water.

The goods had been dyed a very level dark clear yellow having good fastness properties. The PES muffs thus dyed were subjected to an unlevelness test. The result will be given below.

EXAMPLE 2

Figure 2:
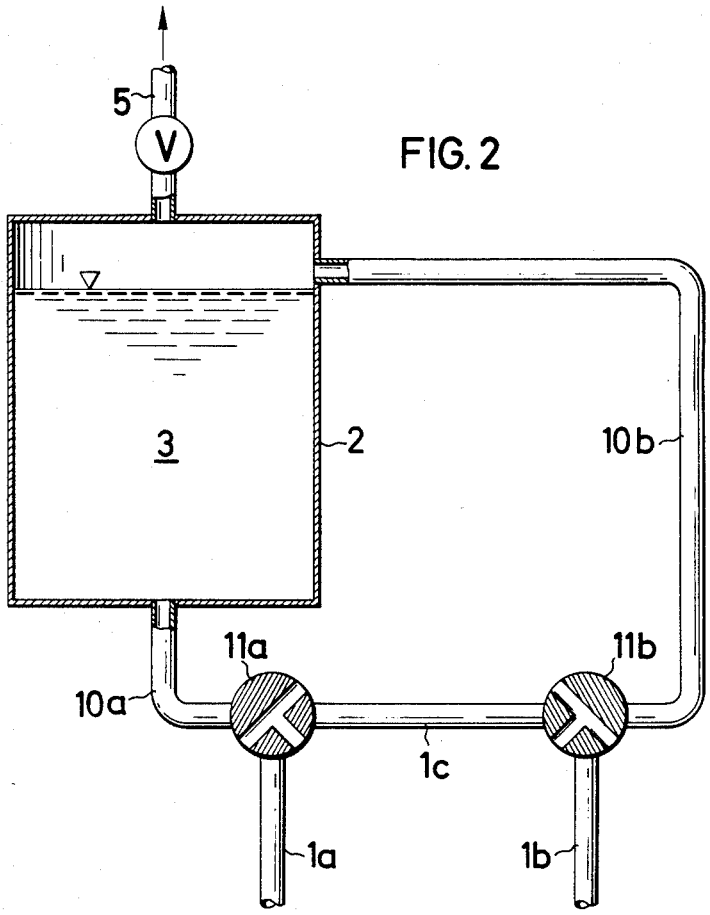
FIG. 2 is a side elevational view of an alternate dyestuff solution metering device for use in a yarn dyeing system.

The following dyeing was carried out in a yarn dyeing machine of the same type as described in Example 1 but where the pipe (1) used to form the liquor cycle has been provided in this case with a meteing device of FIG. 2 which has been connected as a bypass.

In this metering device, a side loop (10*a*, 10*b*) which passes through a make-up or supply vessel (2) for the dyestuff solution (3) which is inserted between the side loop's sections (10*a*) and (10*b*) and is equipped with a valve-sealable pressure release (5) branches off from the pipe section (1*a*) and returns to this pipe a certain distance away in section (1*b*). The three-way cocks (11*a*, 11*b*) located at the two branching points ensure that liquor circulation takes place either only via the circulation system of the dyeing vessel along the pipe sections (1*a* - 1*c* - 1*b*), or via the bypass plus make-up or supply vessel (1*b* - 11*b* - 10*b* - 2 - 10*a* - 11*a* - 1*a*). The metering method in the present case consists in removing, by appropriate activation of the three-way cock (11*b*), hot liquor which is blank or depleted of dyestuff in the direction of flow from the pipes at (1*b*), passing the liquid via the section (10*b*) through the make-up or supply vessel (2), and then returning it via the section (10*a*) and the second two-way cock (11*a*) back into the pipe at (1*a*). This measure has the effect of entraining the dyestuff solution (3) in portions and and then evenly distributing it in the circulating total liquor.

A 700 g PES fiber muff was dyed with unfinished synthesis material of the dyestuff C.I. Disperse Red 183 as follows:

6.3 g of pure dyestuff were dissolved at 20° C. in 200 $cm^3$ of dimethylacetamide, and this solution was deposited, also at room temperature, in the make-up vessel (2) of the metering device of FIG. 2, described above.

In the meantime, a blank liquor of 20 l of water had been acidified to pH 5, and had begun to circulate under the same treatment conditions as in Example 1 via the pipe make up of the sections (1*a*), (1*c*) and (1*b*), through the PES muff mounted in the dyeing vessel.

As soon as the dyeing conditions had been established on the textile goods, the transfer of the dyestuff solution (3) into the dyeing vessel was put in operation. The three-way cocks (11*a*) and (11*b*) are switched over at the same time, and the hot liquor circulated 8 times within a brief period along the path (1*b*) - (11*b*) - (10*b*) - (2) - (10*a*) - (11*a*) - (1*a*) and on each occasion carried over about 25 $cm^3$ of dyestuff solution from the make-up vessel (2) into the circulating liquor.

This dyeing was also terminated after a 20 minute dyeing period, and the dyed PES material was reduction-cleared at 85° C. for 10 minutes with an aqueous bath containing per liter 3 $cm^3$ of 38° Bé NaOH solution, 3 g of sodium dithionite and 1 g of a nonionic detergent, and then rinsed with water.

The goods have been dyed a level dark yellowish red which had good fastensss properties. This muff was also subjected to an unlevelness test, the result of which is shown below.

EXAMPLE 3

14 g of the pure dyestuff C.I. Disperse Red 132 were dissolved at 50° C. in 100 $cm^3$ of dimethyl sulfoxide, and this solution was deposited in the make-up vessel (2) of FIG. 1. The make-up vessel was of the heated type.

The dyeing system of dyeing vessel plus textile material contained therein was of the same type as in Example 1. A blank 20 l liquor circulated through a 700 g PES fiber muff. A dispersant was added to this aqueous, warm liquor at 130° C. in a concentration of 1 g/l, and the liquor was adjusted to pH 5.

When the dyeing conditions had become established, the dyestuff solution was transferred in 8 portions. After it had been metered in, the dyeing operation was continued for a further 20 minutes and then terminated.

The goods thus dyed were finished only by rinsing them with water, giving a pink dyeing having good levelness and good fastness properties. The result of the unlevelness test is shown in the Table below.

EXAMPLE 4

10 g of the pure dyestuff C.I. Solvent Blue 122 are dissolved at 100° C. in 200 $cm^3$ of dimethylformamide, and an 800 g PES fiber muff was dyed with this solution as in Example 3. This muff had to be reduction-cleared to give good fastness properties.

A very level medium blue dyeing was obtained. See below for the result of the unlevelness test.

EXAMPLE 5

Figure 3:
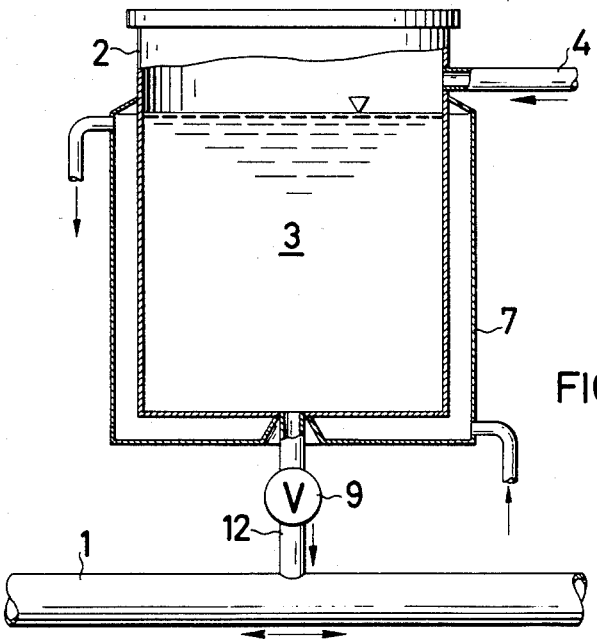
FIG. 3 is a side elevational view of still another dyestuff solution metering device for use in a yarn dyeing system.

The yarn dyeing machine used in this Example is in principle the same as that used in Example 1, except that the pipe (1) provided to form the liquor cycle has, in this case, a connection to the metering device depicted in FIG. 3.

This metering device comprises a make-up or supply vessel (2) for the dyestuff solution (3) and which contains a supply (4) for compressed air or a compressed gas and is surrounded by a heating jacket (7) to control the temperature in the dyestuff solution (3). A transfer line (12) which branches off at the bottom of the vessel and has a metering valve (9) serves as the connection between the make-up or supply vessel (2) and the pipe (1) for the liquor cycle. As soon as a relative overpressure is exerted on the surface of the dyestuff solution (3), the dyestuff solution (3) can be forced in portions, provided the metering valve (9) is open, from the make-up or supply vessel (2) into the pipe (1) containing the liquor cycle, the injected dyestuff solution being evenly distributed in the circulating liquor which is blank or depleted of dyestuff.

1.5 g of the pure colorant C.I. Pigment Red 3, of the C.I. No. 12,120, were dissolved at 110° C. in 150 $cm^3$ of sec.-butyl acetate, and the solution was deposited in the heated make-up vessel (2) of the metering device of FIG. 3, described above.

A PES fiber muff was dyed and aftertreated, both steps being carried out as in Example 4.

A very level pale yellowish red dyeing was obtained. See below for the result of the unlevelness test.

ASSESSMENT OF THE DYEINGS PERFORMED IN THE EXAMPLES, BY MEANS OF AN UNLEVELNESS TEST

According to Weingarten, Melliand Textilberichte 59 (1978), 59–64, the leveling properties of commercial disperse dyestuffs can be determined as follows:

The dyeing is discontinued after a 20 minute dyeing period at a dyeing temperature of 130° C., and 5 samples are taken in radial direction from the dyed PES muffs. The sampling points are evenly distributed along the radius, from the inside to the outside. The samples are dried, and unfixed dyestuff is dissolved off with cold acetone. The dye on fiber concentration of these samples is then spectrophotometrically determined by dissolving the samples in acidified dimethylformamide. The unlevelness is calculated from the measurements of the radial concentration profile by the formula $$Ku\ (\%) = \frac{C_{max} - C_{min}}{C_{min}} \cdot 100$$

($C_{max}$=maximum, $C_{min}$=minimum dyestuff concentration on the fiber of the 5 samples in radial direction).

The smaller the Ku value, the better is the assessment of the leveling properties of the commercial disperse dyestuff.

The following Table compares the $Ku_{20}$ values of the PES dyeings with commercial dyestuffs using the isothermal rapidcolor dyeing method with the $Ku_{20}$ values of the dyeings of Examples 1 to 3 (all roughly of the same depth of shade).

The Table also shows the $Ku_{20}$ values of Examples 4 and 5, where no comparison is possible, since these dyestuffs or pigments could not be used for dyeing PES with existing methods.

| Example Dyestuff | $Ku_{20}$ according to the invention | $Ku_{20}$ Rapidcolor, finished commercial dyestuff |
|---|---|---|
| Example 1 Disperse Yellow 114 | 1 | 4 |

-continued

| Example Dyestuff | $Ku_{20}$ according to the invention | $Ku_{20}$ Rapidcolor, finished commercial dyestuff |
|---|---|---|
| Example 2 Disperse Red 183 | 4 | 20 |
| Example 3 Disperse Red 132 | 5 | 19 |
| Example 4 Solvent Blue 122 | 5 | not applicable |
| Example 5 Pigment Red 3 | 18 | not applicable |

I claim:

1. In a process for the level exhaust dyeing of textile material which consists of hydrophobic synthetic fibers either on its own or as a component of mixtures with natural or other synthetic fibers, with heat-settable colorants in a closed machine system at temperatures between 90° and 140° C., from an aqueous medium by means of a moving liquor which is circulated in the dyeing system until the colorant has exhausted onto the textile material and become fixed therein, the improvement which comprises using as the heat-settable colorant dyestuffs and/or pigments which are virtually insoluble or sparingly soluble in water, without prior formulation with a finish designed for suitable dyeing properties, dissolving the same in one or more organic solvents which, under dyeing conditions, are sufficiently soluble in or miscible with water, and then introducing the solution thus obtained into the circulating aqueous liquor which is already at the dyeing temperature, is flowing through or around the textile material, and is free of dyestuff or depleted of dyestuff whereupon the dyeing is performed as usual.

2. The process as claimed in claim 1, wherein said dyestuffs and/or pigments are soluble in the one or more organic solvents in a sufficiently high concentration.

3. The process as claimed in claim 1, wherein the organic solvent is heated to increase the dyestuff and/or pigment solubility.

4. The process as claimed in claim 1, wherein the organic dyestuff and/or pigment solution is metered into the circulating aqueous liquor in portions at certain intervals.

5. The process as claimed in claim 1, wherein the organic dyestuff and/or pigment solution is metered into the circulating aqueous liquor with alternating flow distributed over several pumping cycles.

6. The process as claimed in claim 1, wherein the organic dyestuff and/or pigment solution is metered into the circulating aqueous liquor in a single charge or in a few portions in the case of good-leveling colorants, and in several portions in the case of poor-leveling colorants.

7. The process as claimed in claim 1, wherein the organic dyestuff and/or pigment solution is metered into the circulating aqueous liquor from a make-up or supply vessel which can be sealed pressure-tight via an appropriate bypass line.

8. The process as claimed in claim 1, wherein the organic dyestuff and/or pigment solution is metered into the circulating aqueous liquor from a make-up or supply vessel which can be sealed pressure-tight, by applying pressure to the surface of the organic solution or by exploiting the sucking action of a pump via an appropriate valve control.

9. The process as claimed in claim 1, wherein a surfactant or a surfactant mixture is added to the organic dyestuff and/or pigment solution in the make-up or supply vessel or to the circulating aqueous liquor which is free or depleted of dyestuff.

10. The process as claimed in claim 1, wherein the aqueous residual liquor left after dyestuff and/or pigment have exhausted is used several times for fresh dyeings provided no troublesome standardizing agent, dispersant or leveling agent residues have been left behind from a preceding dyeing operation.

11. The process as claimed in claim 1, wherein the textile material dyed consists of or contains polyester fibers.

12. A modification of the level dyeing process as claimed in claim 1, which comprises using disperse dyestuffs which have a normal finish but are difficult to dye level, by themselves or mixed with unfinished disperse dyestuffs.

* * * * *